US007611558B2

(12) United States Patent
Oh et al.

(10) Patent No.: US 7,611,558 B2
(45) **Date of Patent: *Nov. 3, 2009**

(54) DUST COMPRESSING APPARATUS OF VACUUM CLEANER

(75) Inventors: Jang-keun Oh, Gwangju (KR); Jin-gon Lee, Gwangju (KR); Seung-yong Cha, Gwangju (KR)

(73) Assignee: Samsung Gwangju Electronics Co., Ltd., Gwangu (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/973,238

(22) Filed: Oct. 5, 2007

(65) Prior Publication Data

US 2008/0264011 A1 Oct. 30, 2008

Related U.S. Application Data

(60) Provisional application No. 60/926,832, filed on Apr. 30, 2007.

(30) Foreign Application Priority Data

Jun. 18, 2007 (KR) ..... 10-2007-0059497

(51) Int. Cl.
*B01D 45/12* (2006.01)
*A47L 9/00* (2006.01)

(52) U.S. Cl. ..... 55/432; 55/429; 55/466; 15/352; 15/353

(58) Field of Classification Search ..... 55/323, 55/428, 432, 429, 459.1, DIG. 3; 15/347, 15/350, 353

See application file for complete search history.

(56) References Cited

U.S. PATENT DOCUMENTS

| | | | | |
|---|---|---|---|---|
| 7,171,725 | B2 * | 2/2007 | Sjoberg et al. | 15/348 |
| 2006/0123750 | A1 * | 6/2006 | Lee et al. | 55/428 |
| 2008/0264014 | A1 * | 10/2008 | Oh et al. | 55/423 |

FOREIGN PATENT DOCUMENTS

| | | | |
|---|---|---|---|
| KR | 1020060031442 | | 4/2006 |
| KR | 1020060098765 | | 9/2006 |
| WO | WO 02/054928 | * | 7/2002 |

* cited by examiner

*Primary Examiner*—Duane Smith
*Assistant Examiner*—Sonji Turner
(74) *Attorney, Agent, or Firm*—Ohlandt, Greeley, Ruggiero & Perle, L.L.P.

(57) ABSTRACT

A dust compressing apparatus of a vacuum cleaner capable of automatically compressing dust or dirt collected in a dust separating unit is disclosed. The dust compressing apparatus includes a compressing plate to compress the dust or dirt collected in the dust separating unit, a moving unit connected to the compressing plate on one side of the dust separating unit to move the compressing plate, an elastic unit to elastically urge the compressing plate to a compressing position where the compressing plate compresses the dust or dirt, and a driving motor to drive the moving unit thus to move the compressing plate.

9 Claims, 4 Drawing Sheets

DUST COMPRESSING APPARATUS OF VACUUM CLEANER

CROSS-REFERENCE TO RELATED APPLICATIONS

This application claims the benefit under 35 U.S.C. §119 of U.S. Provisional Patent Application No. 60/926,832, filed Apr. 30, 2007, in the United States Patent and Trademark Office, and Korean Patent Application No. 10-2007-0059497, filed on Jun. 18, 2007, in the Korean Intellectual Property Office, the entire contents of which are hereby incorporated by reference.

BACKGROUND OF THE INVENTION

1. Field of the Invention

The present disclosure relates to a vacuum cleaner. More particularly, the present disclosure relates to a cyclone dust separating apparatus of a vacuum cleaner, which draws in external air and separates dust or dirt from the drawn-in air.

2. Description of the Related Art

In general, a cyclone dust separating apparatus provided in a vacuum cleaner is an apparatus, which whirls air laden with dirt or dust and separates the dirt or dust therefrom. Such a cyclone dust separating apparatus has been recently widely used because it can be semi-permanently used without any inconvenience of frequently replacing dust bags.

The cyclone dust-separating apparatus usually has a cyclone structure, which includes a cyclone to make drawn-in air into a whirling current and thus to separate dust or dirt from the drawn-in air, an air inflow part to guide the drawn-in air to flow into the cyclone in a tangential direction thereof, and a dust bin to collect and store the separated dust or dirt therein. In the cyclone structure as described above, the dust or dirt is randomly accumulated in the dust bin by the whirling air in the cyclone when it is collected in the dust bin. Thus, the conventional cyclone dust-separating apparatus presents a problem that the dust or dirt is apt to scatter along with the whirling air and to flow backward into the cyclone again and as a result, a dust-separating efficiency is deteriorated.

In addition, since the dust or dirt is loosely accumulated in the dust bin, a time that the dust bin is filled with the dust or dirt is shortened, so that a user should frequently empty the dust or dirt from the dust bin. Moreover a problem may occur, in that when the dust bin is emptied, the dust or dirt loosely accumulated in the dust bin is scattered to contaminate the surroundings.

To address the problems as described above, a vacuum cleaner having a dust compressing apparatus, which compresses dust or dirt collected and stored in a dust bin, is disclosed in Korean Patent No. 10-606794. The dust compressing apparatus of the vacuum cleaner is provided with a compressing plate to compress dust or dirt in a dust bin, a plunger connected to the compressing plate, a solenoid unit to drive the plunger up and down, and a restoring member to restore the lowered plunger to an original position. Accordingly, if the solenoid unit is operated to move the plunger down, the compressing plate is lowered to compress the dust or dirt in the dust bin. However, the dust compressing apparatus as described above is configured, so that the plunger and the restoring member are disposed below the compressing plate while penetrating through the dust bin. Accordingly, to empty the dust bin, the plunger and the restoring member together with the dust bin should be disassembled. Thus, the above dust compressing apparatus is disadvantageous in that it is difficult to remove the dust or dirt compressed in the dust bin.

Also, another vacuum cleaner having a dust compressing apparatus, which compresses dust or dirt collected and stored in a dust bin, is disclosed in Korean Patent No. 10-634805. The dust compressing apparatus of the vacuum cleaner is provided with a button slidably installed to a dust tank cover of a dust casing, an elastic member to elastically support the button in a direction projecting from the dust casing, and a compressing plate slidably installed in the dust casing to compress the dust or dirt in the dust casing. Accordingly, if the user pushes down the button, the compressing plate compresses the dust or dirt in the dust casing. However, the dust compressing apparatus as described above is disadvantageous in that to compress the dust or dirt in the dust casing, the user should manually operate the button.

SUMMARY OF THE INVENTION

An aspect of the present disclosure is to address at least the above problems and/or disadvantages and to provide at least the advantages described below. Accordingly, an aspect of the present disclosure is to provide a dust compressing apparatus of a vacuum cleaner capable of automatically compressing dust or dirt collected in a dust separating unit and at the same time, easily dumping the dust or dirt collected in the dust separating unit.

In accordance with an aspect of the present disclosure, a dust compressing apparatus of a vacuum cleaner includes a compressing plate to compress dust or dirt collected in a dust separating unit, a moving unit connected to the compressing plate on one side of the dust separating unit to move the compressing plate, an elastic unit to elastically urge the compressing plate to locate to a compressing position where the compressing plate compresses the dust or dirt, and a driving motor to drive the moving unit thus to move the compressing plate.

Here, the moving unit may include a rope connected to the compressing plate, and a pulley connected to a driving axis of the driving motor. The pulley is connected to the driving axis of the driving motor to rotate by the driving axis and thus to wind or unwind the rope thereon or therefrom. In this case, the compressing plate is moved to a releasing position where the compressing plate is moved away from the dust or dirt against an elastic force of the elastic unit when the pulley is rotated to wind the rope thereon, and moved to the compressing position by the elastic force of the elastic unit when the pulley is rotated to unwind the rope therefrom.

The elastic unit may include at least one compression spring disposed between the compressing plate and a main body of the dust separating unit to elastically urge the compressing plate to the compressing position.

The dust separating unit may include at least one cyclone, and a dust bin unit to collect and store the dust or dirt separated by the cyclone therein. At this time, the cyclone may include a cyclone body having an air inlet and an air outlet, a guide member disposed to one side of the cyclone body in the cyclone body to guide air flowed in through the air inlet, an outflow pipe disposed to the other side of the cyclone body to communicate with the air outlet, and a dust discharging opening formed to a portion of the other side of the cyclone body to face the dust bin unit. Also, the dust bin unit may include a dust bin disposed parallel to the cyclone body and having an end to communicate with the dust discharging opening.

In this case, the compressing plate may include a plate formed in a shape corresponding to a cross section of the dust bin to move in the dust bin. Also, the dust bin may further include a dust bin cover disposed at an opposite end to the end, which communicates with the dust discharging opening, to open and close the dust bin.

The driving of the driving motor may be controlled by one of a change in load of the driving motor and limit switches disposed at the compressing position and the releasing position of the compressing plate.

BRIEF DESCRIPTION OF THE DRAWING FIGURES

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a dust compressing apparatus of a vacuum cleaner according to exemplary embodiments of the present disclosure will be described in detail with reference to the accompanying drawing figures.

Figure 1:
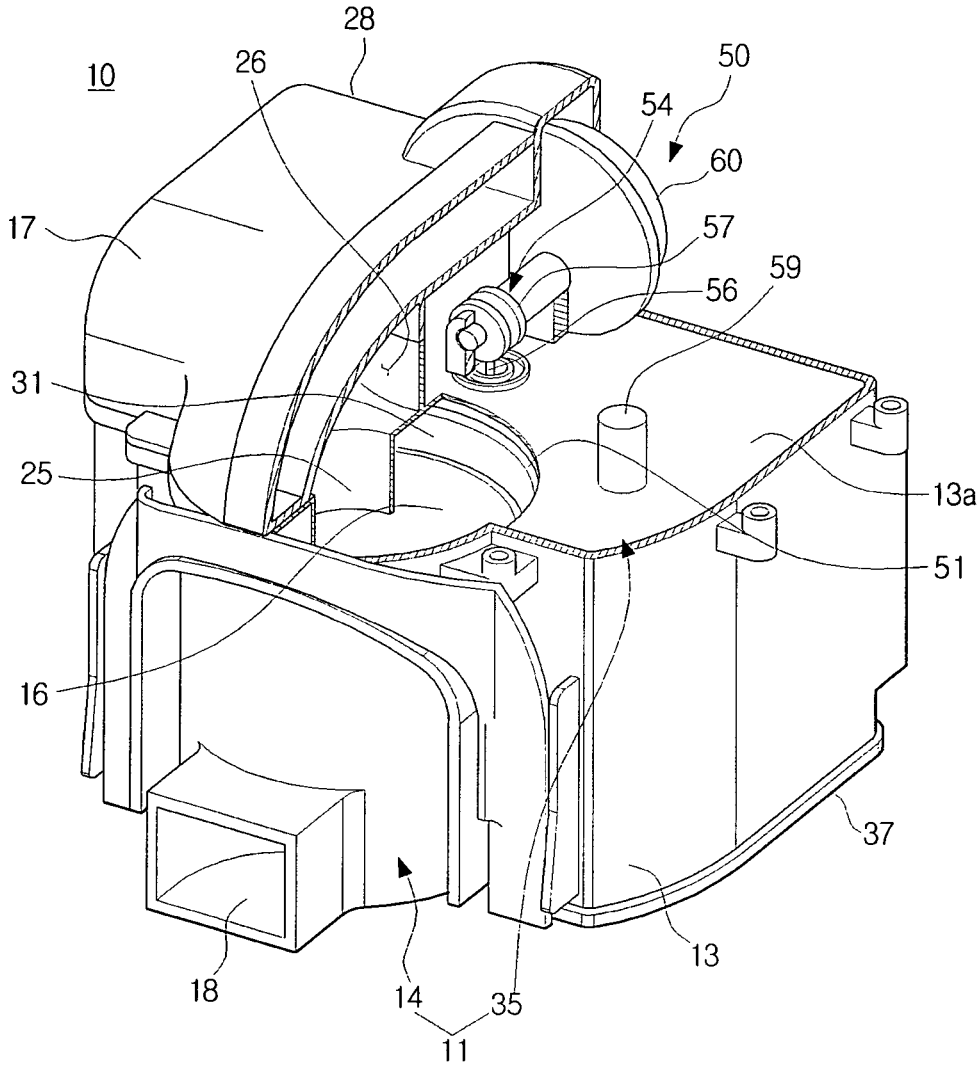
FIG. 1 is a partially cut-away perspective view exemplifying a cyclone dust separating apparatus of a vacuum cleaner to which a dust compressing apparatus according to an exemplary embodiment of the present disclosure is applied.
Figure 2A:
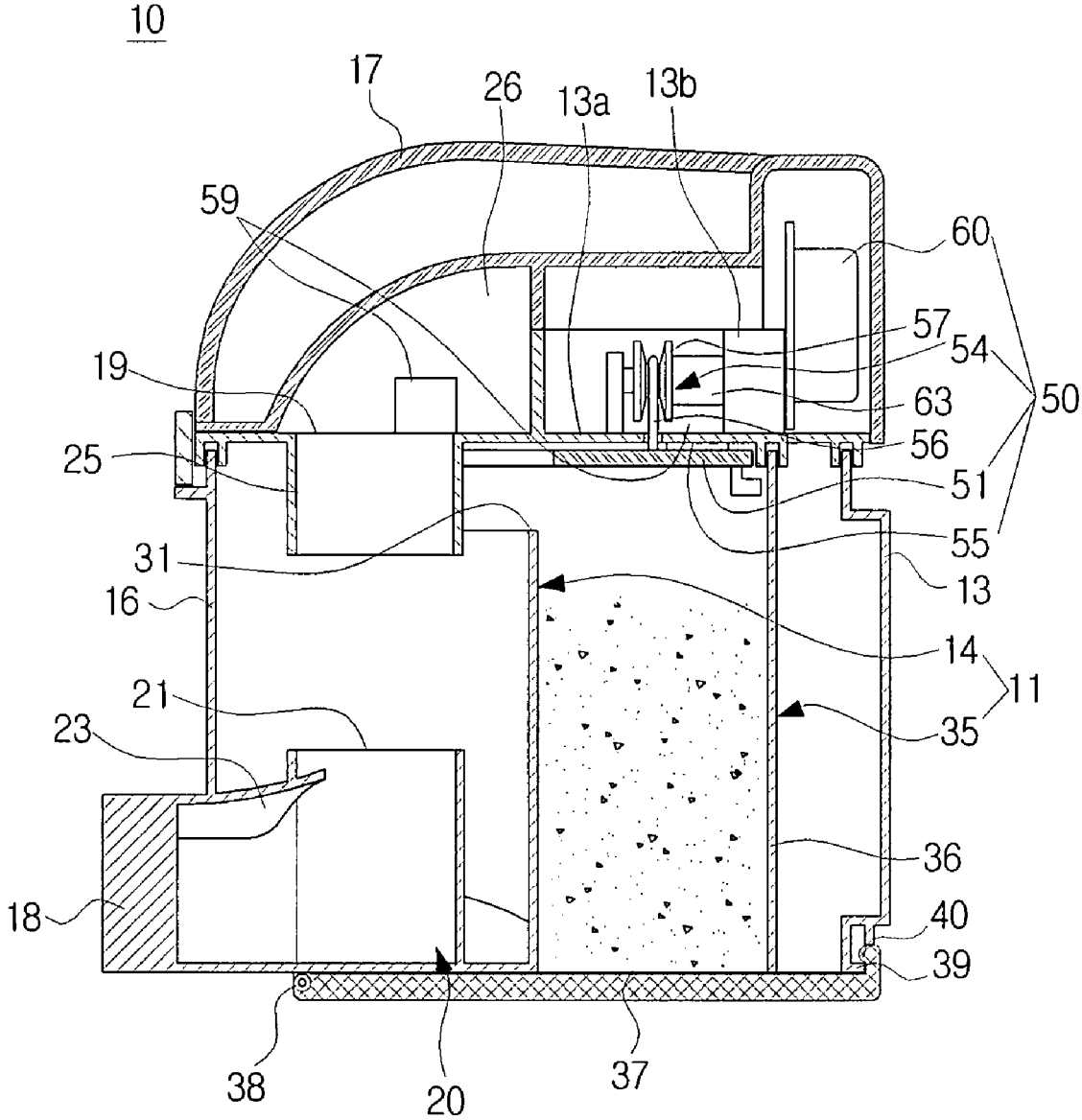
FIGS. 2A and 2B are cross-sectional views exemplifying an operation of an dust compressing apparatus of the cyclone dust separating apparatus illustrated in FIG. 1.
Figure 2B:
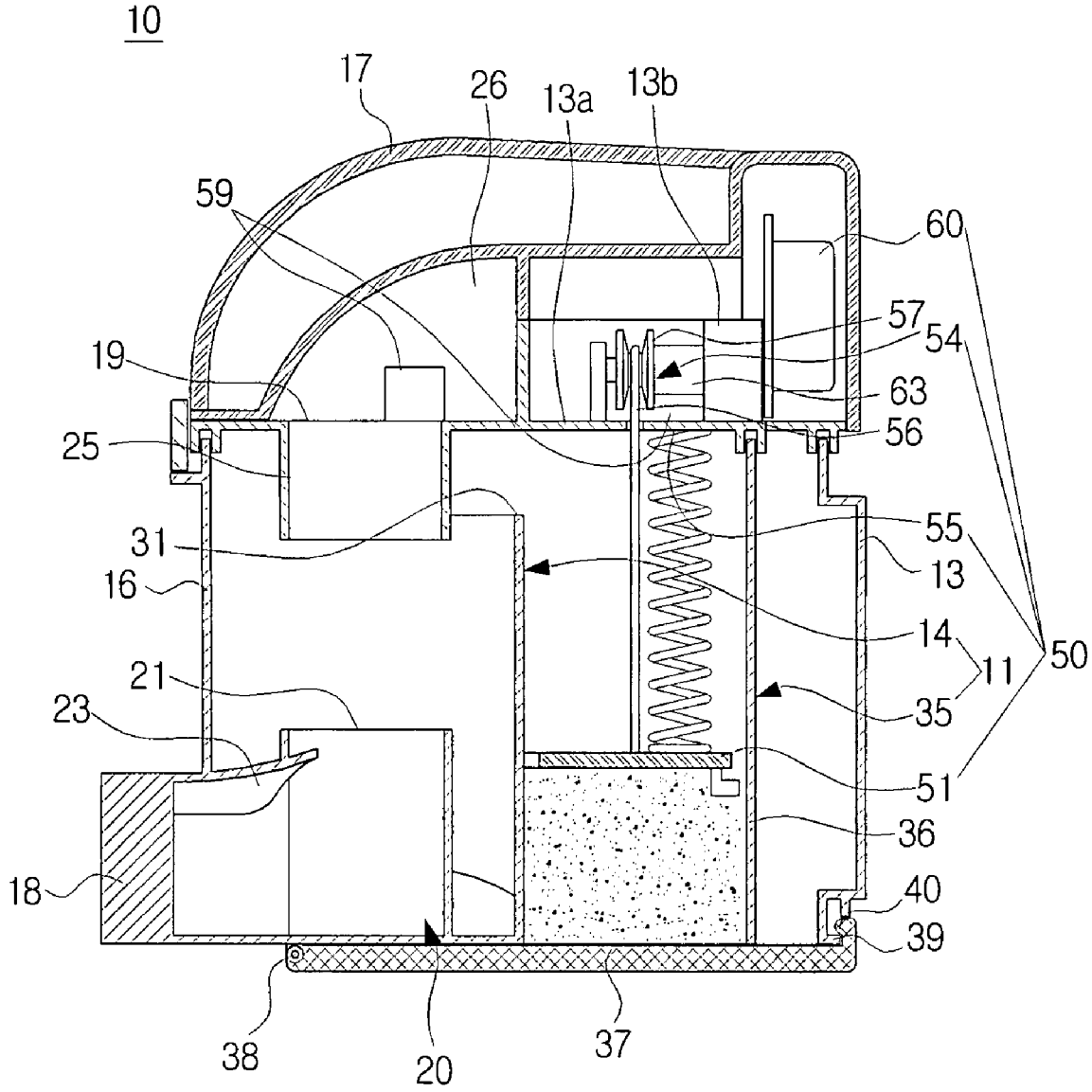

FIGS. 1, 2A and 2B are a partially cut-away perspective view and cross-sectional views exemplifying a cyclone dust separating apparatus of a vacuum cleaner to which a dust compressing apparatus according to an exemplary embodiment of the present disclosure is applied.

Referring to FIGS. 1, 2A and 2B, the cyclone dust separating apparatus 10 of the vacuum cleaner of the present disclosure includes a dust separating unit 11 to separate and collect dust or dirt from air by using a suction force of a suction motor (not illustrated) of the vacuum cleaner, and a dust compressing apparatus 50 according to the exemplary embodiment of the present disclosure to compress the dust or dirt collected in the dust separating unit 11.

The dust separating unit 11 is provided with a cyclone 14 and a dust bin unit 35.

The cyclone 14 separates dust or dirt out of the air drawn in from the outside by the suction force of the suction motor. For this, the cyclone 14 is provided with a cyclone body 16 disposed at one side of a main body 13 in such a manner that a longitudinal axis thereof is vertically arranged. The cyclone body 16 is formed in a cylinder shape having an air inlet 18 and an air outlet 19 (see FIGS. 2A and 2B) formed in one side of a lower end and the middle of an upper end thereof, respectively. At this time, the upper end of the cyclone body 16 is defined by an intermediate wall 13*a* of the main body 13. As illustrated in FIGS. 2A and 2B, to guide the air drawn into the cyclone body 16 through the air inlet 18, a guide member 20 is disposed on the part of the lower end of the cyclone body 16. The guide member 20 is provided with a guide pipe 21 and a spiral blade 23, so that it guides the air drawn into the cyclone body 16 to whirl in a spiral shape. An outflow pipe 25 is disposed in the air outlet 19 formed on the part of the upper end of the cyclone body 16. The outflow pipe 25 guides the air whirling in the spiral shape by means of the guide member 20 in the cyclone body 16 to rotate in a spiral shape and at the same time, to discharge through the air outlet 19.

The air outlet 19 is communicated with an air discharging passage 26 of an upper cover 17. The upper cover 17 is provided with an air discharging opening 28 (see FIG. 1), which is directly or indirectly connected with the suction motor of the vacuum cleaner. A filter (not illustrated) can be installed in the air discharging passage 26 of the upper cover 17 to filter minute dust or dirt, which is not separated from the air by the cyclone 14. At this time, the filter may be formed of a sponge type filter, a high efficiency particulate arrestor (HEPA) filter, or a combination thereof.

A dust discharging opening 31 is formed in one side of an upper part of the cyclone body 16. The dust discharging opening 31 is communicated with a dust bin 36 of the dust bin unit 35, which will be described, so that it discharges the dirt or dust separated from the air by the cyclone 14, into the dust bin 36.

The dust bin unit 35 collects and stores the dust or dirt discharged through the dust discharging opening 31. The dust bin unit 35 includes a dust bin 36, which is disposed parallel to the cleaner body 16 and vertically in the main body 13. The dust bin 36 is formed in an approximately hexahedral tube shape, which surrounds the cyclone body 16. The dust bin 36 at an upper end thereof is defined by the intermediate wall 13*a* and at one lower side of the upper end thereof is opened to communicate with the dust discharging opening 31. On a lower part of the dust bin 36 is disposed a dust bin cover 37 to open and close the dust bin 36. Thus, the dust bin 36 can dump the dust or dirt collected therein. The dust bin cover 37 at one end thereof is hinged to a hinge axis 38 on an undersurface of the main body 13 and at the other end thereof has a hook 40 locked in a hooking groove 39 formed in a lower part of the main body 13. Accordingly, the dust bin cover 37 is pivoted on the hinge axis 38, so that the hook 40 can be locked in or released from the hooking groove 39. Thus, the dust bin cover 37 can open or close up the lower part of the dust bin 36.

Referring to FIGS. 2A through 3B, the dust compressing apparatus 50 is disposed above the dust bin 36. The dust compressing apparatus 50 is provided with a compressing plate 51, a moving unit 54, an elastic unit 55, and a driving motor 60. The compressing plate 51, which compresses the dust or dirt collected in the dust bin 36, is made of a plate formed in a shape corresponding to a cross section of the dust bin 36 to move up and down in the dust bin 36. The moving unit 54 is connected to the compressing plate 51 on the upper part of the dust bin 36. The moving unit 54 moves the compressing plate 51 to a compressing position (see FIGS. 2B and 3B) where the compressing plate 51 compresses the dust or dirt and a releasing position (see FIGS. 2A and 3A) where the compressing plate 51 is moved away from the dust or dirt, in combination with the elastic unit 55, which will be described in detail. For this, the moving unit 54 is provided with a rope 56 and a pulley 57. The rope 56 at one end thereof is connected to a fixing hanger 58 formed in the middle of the compressing plate 51 and at the other end thereof is fixed to the pulley 57. The pulley 57 is integrally formed with a driving axis 63 of the driving motor 60, so that it is rotated by the driving axis 63.

The elastic unit 55 is made up of at least one, for example, three compression springs disposed in at least one, for example, three spring-accommodating parts 59 to face and to come in contact with the compressing plate 51. The three spring-accommodating parts 59 are projected in a spaced-apart relation to one another in an upward direction from the intermediate wall 13*a* of the main body 13, which forms the upper ends of the dust bin 36 and the cyclone body 16. The elastic unit 55 elastically urges the compressing plate 51 to maintain the compressing position (see FIGS. 2B and 3B).

Accordingly, the compressing plate 51 is moved to the releasing position (see FIGS. 2A and 3B) against an elastic force of the elastic unit 55 when the rope 56 is wound on the pulley 57 by the rotation of the driving axis 63, and moved to the compressing position (see FIGS. 2B and 3B) by the elastic force of the elastic unit 55 when the rope 56 is unwound from the pulley 57 by the rotation of the driving axis 63.

The driving motor 60, which drives the moving unit 54 to move the compressing plate 51, is installed on a fixing bracket 13*b* formed on the intermediate wall 13*a* of the main body 13. The driving motor 60 is provided with a driving axis 63 coaxially connected with the pulley 57. The rotation of the driving motor 60 can be controlled by a control unit (not illustrated). That is, when the rope 56 is completely wound on the pulley 57, the driving motor 60 is rotated no longer, but it suffers an overload. At this time, the control unit detects a change of current according to a change of load through corresponding circuits, so that it senses the overload of the driving motor 60 and stops driving the driving motor 60. To the contrary, when the rope 56 is completely unwound from the pulley 57, the driving motor 60 almost suffers no overload. At this time, the control unit detects the change of current according to the change of load through the circuits, so that it senses the non-overload of the driving motor 60 and drives the driving motor 60 in a reverse direction. Alternatively, the rotation of the driving motor 60 can be controlled by limit switches (not illustrated) disposed in the dust bin 36 to detect the compressing position and the releasing position of the compressing plate 51.

In the above description, although the cyclone dust separating apparatus 10 to which the dust compressing apparatus according to the exemplary embodiment of the present disclosure is applied is illustrated and explained as having the cyclone body 16 of the cyclone 14 and the dust bin 36 of the dust bin unit 35 disposed in such a manner that the longitudinal axes thereof are vertically arranged, the present disclosure is not limited thereto. For instance, the dust compressing apparatus 50 according to the exemplary embodiment of the present disclosure is applicable to a cyclone dust separating apparatus having a cyclone body 16 and a dust bin 36 disposed in such a manner that longitudinal axes thereof are horizontally arranged, in the same construction and principle.

As described above, the cyclone dust separating apparatus 10 of the present disclosure is configured, so that the dust compressing apparatus 50 automatically ascends or descends the compressing plate 51 through the rope 56 and the pulley 57, which is operated by the driving motor 60, thereby allowing the compressing plate 51 to compress the dust or dirt collected and stored in the dust bin 36. Accordingly, the problem that the user should manually compress the compressing plate 51 through the button as in the conventional apparatus can be addressed.

Also, the cyclone dust separating apparatus 10 of the present disclosure is configured, so that the rope 56 and the pulley 57 of the dust compressing apparatus 50 are located above the compressing plate 51 on the upper part of the dust bin 36 and the dust bin cover 37 is located on the lower part of the dust bin 36. Accordingly, to dump the dust or dirt compressed in the dust bin 36, there is no need of disassembling the dust compressing apparatus 50. Thus, the cyclone dust separating apparatus 10 of the present disclosure is advantageous in that it is easy to empty the dust or dirt from the dust bin 36.

Hereinafter, an operation of the cyclone dust separating apparatus 10 to which the dust compressing apparatus according to the exemplary embodiment of the present disclosure is applied, constructed as described above, will be now explained in detail with reference to FIGS. 1 through 3B.

Figure 3A:
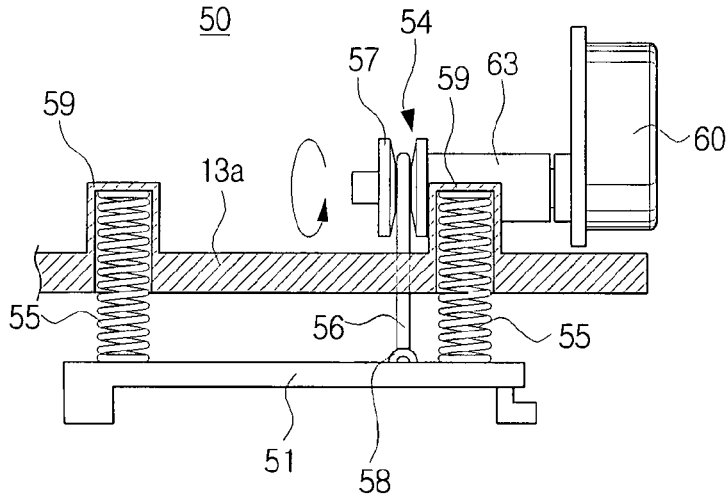
FIGS. 3A and 3B are partial cross-sectional views exemplifying the dust compressing apparatus illustrated in FIGS. 2A and 2B, respectively.

First, the compressing plate 51 of the dust compressing apparatus 50 at an early state thereof is positioned in a releasing position illustrated in FIGS. 2A and 3A. At this time, the rope 56 is completely wound on the pulley 57.

In this state, if the vacuum cleaner is supplied with the power, air laden with dust or dirt adhered to a surface to be cleaned is drawn into the cyclone body 16 through the air inlet 18 by an suction force of the suction motor directly or indirectly connected to the air discharging opening 28 of the upper cover 17. The drawn-in air forms a whirling current through the guide member 20 and the outflow pipe 25. As a result, the dust or dirt included in the drawn-in air is discharged into the dust bin 36 through the dust discharging opening 31 due to the centrifugal force, and collected and stored in the dust bin 36. And, the dust-removed air passes through the outflow pipe 25 and discharges to a cleaner body (not illustrated) in which the suction motor is installed, through the air discharging passage 26 and the air discharging opening 28 of the upper cover 17.

After the cleaning operation is completed as described above, if the user wants to compress the dust or dirt collected and stored in the dust bin 36, she or he pushes down a compression-executing button (not illustrated) of an operating panel (not illustrated) of the vacuum cleaner. According to this, the control unit drives the driving motor 60 in one direction, for example, a clockwise direction. Here, instead of driving the driving motor 50 when the user pushes down the compression-executing button, the control unit can be set to automatically drive the driving motor 60 when a dust detecting sensor (not illustrated) having a light emitting part and a light receiving part installed at a certain height in the dust bin 36 is operated.

As the driving motor 60 is driven in the clockwise direction, the pulley 57 coaxially formed with the driving axis 63 is also rotated in the clockwise direction to unwind the rope 56 therefrom. As a result, the compressing plate 51 is lowered to a compressing position (see FIGS. 2B and 3B) by an elastic force of the elastic unit 55, so that it compresses the dust or dirt collected and stored in the dust bin 36.

Figure 3B:
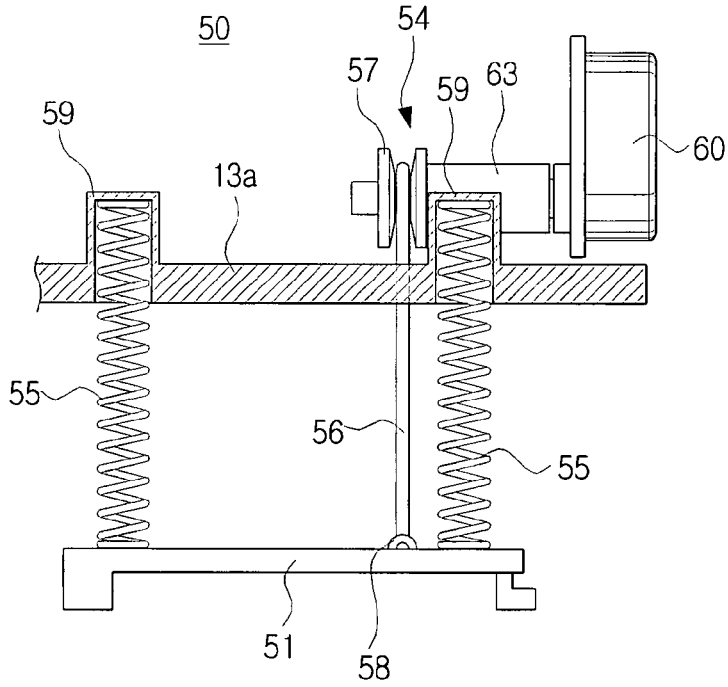

As illustrated in FIGS. 2B and 3B, when the compressing plate 51 almost compresses the dust or dirt in the dust bin 36, the rope 56 is completely unwound from the pulley 57. As a result, the driving motor 60 almost suffers no overload. At this time, the control unit detects a change of current according to a change of load, so that it senses a non-overload of the driving motor 60 and drives the driving motor 60 in a reverse direction, that is, a counterclockwise direction.

When, the driving motor is rotated in the counterclockwise direction, the rope 56 is wound on the pulley 57 again. After that, when the rope 56 is completely wound oh the pulley 57 by the rotation of the driving axis 63, the driving motor suffers an overload. At this time, the control unit detects the change of current according to the change of load, so that it senses the overload of the driving motor 60 and stops driving the driving motor 60. Thus, the dust compressing operation of the dust compressing apparatus 50 is completed.

After the dust compressing operation is completed as described above, if the user wants to dump the dust or dirt compressed in the dust bin 36, she or he releases the hook 40 of the dust bin cover 37 from the hooking groove 39, opens the lower part of the dust bin 36 by pivoting the dust bin cover 37 on the hinge axis 38, and then removes the dust or dirt from the dust bin 36. And then, the user operates the dust bin cover 37 in a reverse order to an order of opening the dust bin 36 so as to close up the dust bin 36.

As apparent from the foregoing description, according to the exemplary embodiment of the present disclosure, the cyclone dust separating apparatus of the present disclosure is configured, so that the dust compressing apparatus automatically ascends or descends the compressing plate through the rope and the pulley, which is operated by the driving motor, thereby allowing the compressing plate to compress the dust or dirt collected and stored in the dust bin. Accordingly, the problem that the user should manually compress the compressing plate through the button as in the conventional apparatus can be addressed.

Also, the cyclone dust separating apparatus of the present disclosure is configured, so that the rope and the pulley of the dust compressing apparatus are located above the compressing plate on the upper part of the dust bin and the dust bin cover is located on the lower part of the dust bin. Accordingly, to dump the dust or dirt compressed in the dust bin, there is no need of disassembling the dust compressing apparatus. Thus, the cyclone dust separating apparatus of the present disclosure is advantageous in that it is easy to empty the dust or dirt from the dust bin.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A dust compressing apparatus of a vacuum cleaner, comprising:

a compressing plate to compress dust or dirt collected in a dust separating unit;

a moving unit connected to the compressing plate on one side of the dust separating unit to move the compressing plate;

an elastic unit to elastically urge the compressing plate to a compressing position where the compressing plate compresses the dust or dirt; and a driving motor to drive the moving unit to move the compressing plate, wherein the elastic unit is disposed on a surface opposite to a surface of the compressing plate by which the dust or dirt is compressed.

2. The dust compressing apparatus as claimed in claim 1, wherein the moving unit comprises a rope connected to the compressing plate, and a pulley connected to a driving axis of the driving motor, the pulley being connected to the driving axis of the driving motor to rotate by the driving axis and to wind or unwind the rope thereon or therefrom, and wherein the compressing plate is configured to move to a releasing position where the compressing plate is moved away from the dust or dirt against an elastic force of the elastic unit when the pulley is rotated to wind the rope thereon, and wherein the compressing plate is configured to move to the compressing position by the elastic force of the elastic unit when the pulley is rotated to unwind the rope therefrom.

3. The dust compressing apparatus as claimed in claim 1, wherein the elastic unit comprises at least one compression spring disposed between the compressing plate and a main body of the dust separating unit to elastically urge the compressing plate to the compressing position.

4. The dust compressing apparatus as claimed in claim 1, wherein the dust separating unit comprises:

at least one cyclone; and a dust bin unit to collect and store the dust or dirt separated by the cyclone therein.

5. The dust compressing apparatus as claimed in claim 4, wherein the cyclone comprises:

a cyclone body having an air inlet and an air outlet;

a guide member disposed to one side of the cyclone body in the cyclone body to guide air flowed in through the air inlet;

an outflow pipe disposed to a second side of the cyclone body to communicate with the air outlet; and a dust discharging opening formed to a portion of the second side of the cyclone body to face the dust bin unit.

6. The dust compressing apparatus as claimed in claim 5, wherein the dust bin unit comprises a dust bin disposed parallel to the cyclone body, and wherein the dust bin unit has an end to communicate with the dust discharging opening.

7. The dust compressing apparatus as claimed in claim 6, wherein the compressing plate comprises a plate formed in a shape corresponding to a cross section of the dust bin to move in the dust bin.

8. The dust compressing apparatus as claimed in claim 6, wherein the dust bin further comprises a dust bin cover disposed at an opposite end to the end that communicates with the dust discharging opening to open and close the dust bin.

9. The dust compressing apparatus as claimed in claim 1, wherein driving of the driving motor is controlled by a change in load of the driving motor or limit switches disposed at the compressing position and a releasing position of the compressing plate.

* * * * *